United States Patent [19]

Hyltin et al.

[11] Patent Number: 4,501,939

[45] Date of Patent: Feb. 26, 1985

[54] DIGITAL JOYSTICK CONTROLLER

[75] Inventors: Tom M. Hyltin, Dallas; Thomas G. Milner, Fort Worth; Elam C. Frye, Jr., Dallas, all of Tex.

[73] Assignee: Personal Peripherals Inc., Irving, Tex.

[21] Appl. No.: 548,658

[22] Filed: Nov. 4, 1983

[51] Int. Cl.[3] ..... H01H 25/00

[52] U.S. Cl. ..... 200/6 A; 200/133 K

[58] Field of Search ..... 200/5 R, 5 A, 6 R, 6 A, 200/17 R, 6 C, 153 K, 7, 303; 273/85 G

[56] References Cited

U.S. PATENT DOCUMENTS

| | | | |
|---|---|---|---|
| 1,886,284 | 11/1932 | Luther | 200/5 A |
| 2,849,548 | 8/1958 | Young | 200/6 A |
| 3,033,946 | 5/1962 | Meyer et al. | 200/6 A |
| 3,600,528 | 8/1971 | Leposavic | 200/5 A |
| 3,742,157 | 6/1973 | Leposavic | 200/5 A |
| 3,996,429 | 12/1976 | Chu et al. | 200/5 A |
| 4,394,548 | 7/1983 | Dola | 200/6 A |

*Primary Examiner*—J. R. Scott

*Attorney, Agent, or Firm*—Hubbard, Thurman, Turner & Tucker

[57] ABSTRACT

A digital joystick controller is disclosed which utilizes a plastic base portion and a pivotally mounted "joystick." A plurality of electrical contacts are disposed within the bottom of the base portion and a planar conductive member is suspended a selected distance above the electrical contacts. The planar conductive member includes a number of elongate sections which serve to urge the joystick into an erect position and which deflect to contact selected ones of the plurality of electrical contacts in response to manual displacement of the joystick from an erect position. In a preferred embodiment of the present invention an elongate button switch is disposed within the joystick and is axially movable therein. An elongate section of the planar conductive member is utilized to urge the button switch into a first position and to selectively contact a particular electrical contact in response to manual depression of the button switch.

15 Claims, 4 Drawing Figures

DIGITAL JOYSTICK CONTROLLER

BACKGROUND OF THE INVENTION

This invention relates to joystick controls in general and in particular to joystick controls which generate a digital signal indicative of the relative position of the joystick.

Joystick controls are well known in the prior art. Such controls are often utilized to position or locate a cursor or other indicator at a particular location in a video display such as those displays utilized in video arcade games. Many prior art joysticks are analog devices and utilize one or more potentiometers to provide an analog indication of the relative position of the joystick. This is typically accomplished by mounting the potentiometers in fixed relationships to the joystick and then controlling one potentiometer by movement of the joystick in an X plane and controlling a second potentiometer by movement of the joystick in the Y plane. Thus, the position of the joystick determines the relative resistance of two potentiometers which in turn are utilized to alter suitable electrical signals. Since many such systems utilize microprocessor control systems which require digital inputs, it is common to couple the outputs of such analog joystick controls through an analog to digital converter prior to coupling these signals to the microprocessor.

Recently, several designs have been utilized to directly generate digital signals which are indicative of the relative position of the joystick. These so-called digital joysticks are often complex devices which utilize a plurality of complex electrical contactors to generate a digital signal indicative of the position of the joystick. Examples of such digital joysticks can be seen in U.S. Pat. No. 4,148,014 and U.S. Pat. No. 4,161,726.

As those skilled in the art will appreciate, there are numerous advantages to be obtained with a joystick control system which generates digital signals indicative of the joystick position; however, the increased complexity of these systems often makes manufacture and assembly very difficult. This is particularly true in those systems in which it is desired to bias the joystick to a neutral or centered position so that in the absence of a continual manual input the movement of the controlled cursor will stop rather than continue in the direction last entered.

SUMMARY OF THE INVENTION

Therefore, it is one object of the present invention to provide an improved joystick controller.

It is another object of the present invention to provide an improved digital joystick controller.

It is yet another object of the present invention to provide an improved digital joystick controller which permits highly cost effective manufacture and assembly.

It is another object of the present invention to provide an improved digital joystick controller which utilizes a single planar conductive member to urge the joystick into a neutral position and to selectively contact particular electrical contacts in response to manual displacement of the joystick from the neutral position.

The foregoing objects are achieved as is now described. The joystick controller of the present invention is provided with a plastic base portion upon which the joystick is pivotally mounted. A plurality of electrical contacts are disposed within the bottom of the base portion and a planar conductive member is suspended a selected distance above the electrical contacts. The planar conductive member includes a number of elongate sections which serve to urge the joystick into an erect position and which deflect to contact selected ones of the plurality of electrical contacts in response to manual displacement of the joystick from an erect position. In a preferred embodiment of the present invention an elongate button switch is disposed within the joystick and is axially movable therein. An elongate section of the planar conductive member is utilized to urge the button switch into a first position and to selectively contact a particular electrical contact in response to manual depression of the button switch.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
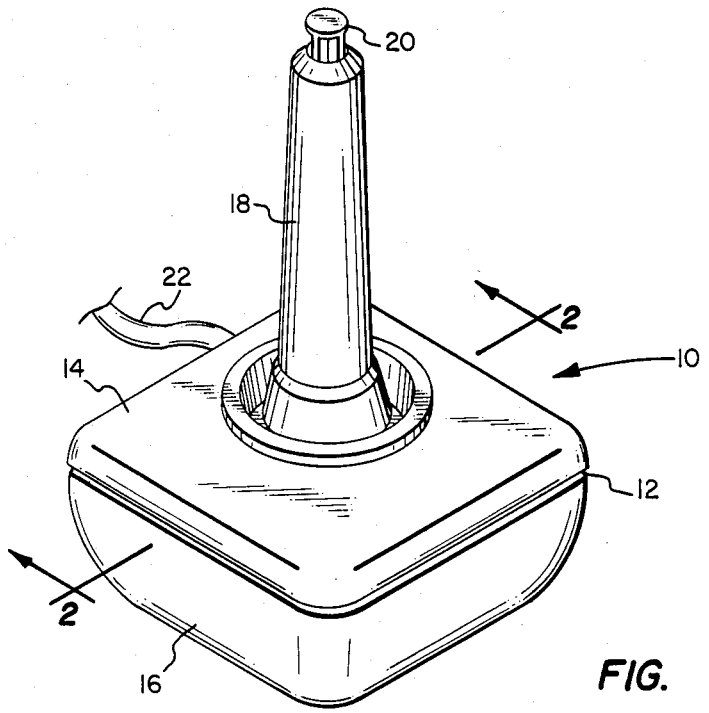
FIG. 1 is a perspective view of the novel digital joystick controller of the present invention.

Referring now to the figures, and in particular to FIG. 1, there is depicted a perspective view of novel digital joystick controller 10 of the present invention. As can be seen, joystick controller 10 includes a base portion 12 having an upper portion 14 and a lower portion 16. In a preferred embodiment of the present invention, base portion 12 is formed of a plastic material suitable for use with known plastic molding techniques. An elongate joystick 18 is pivotally mounted at the lower end thereof through the upper surface of base portion 12 and a momentary contact switch or "fire" button 20 is disposed at the upper end of joystick 18. Again, in a preferred embodiment of the present invention, joystick 18 and fire button 20 are both constructed utilizing plastic materials suitable for use with known plastic molding techniques. As is also typical in this art, a control cable 22 which includes a plurality of elongate conductive wires is provided to electrically couple selected contact points within controller 10 to an accompanying digital controller in the video system (not shown).

Figure 2:
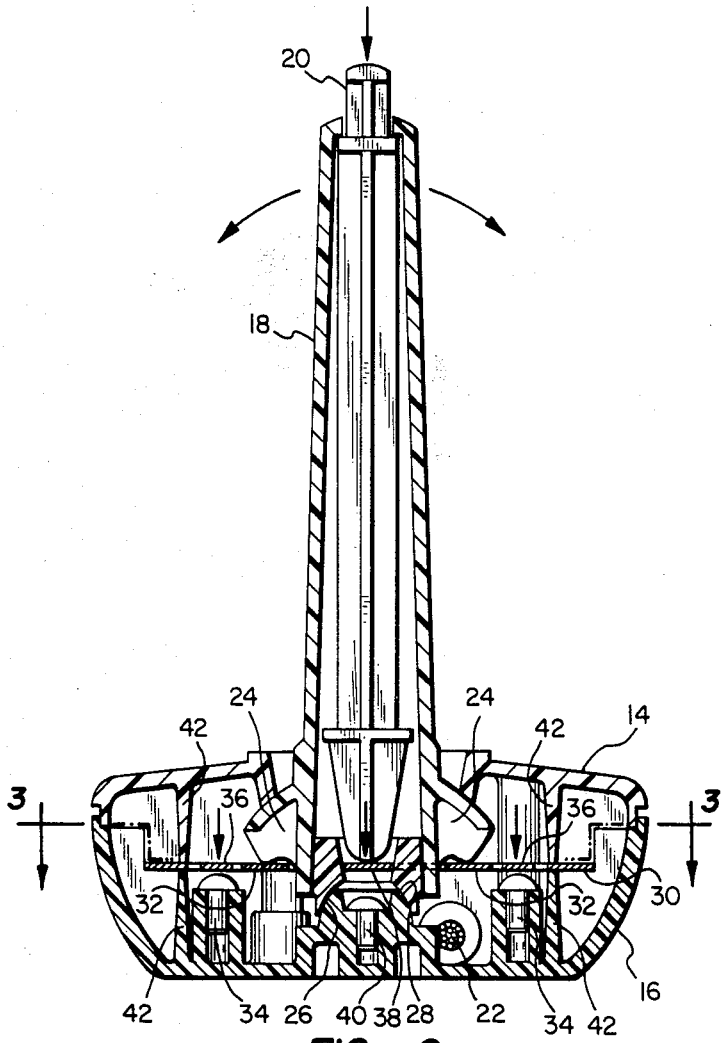
FIG. 2 is a sectional view of the novel digital joystick controller of the present invention taken along line 2—2 of FIG. 1.
Figure 3:
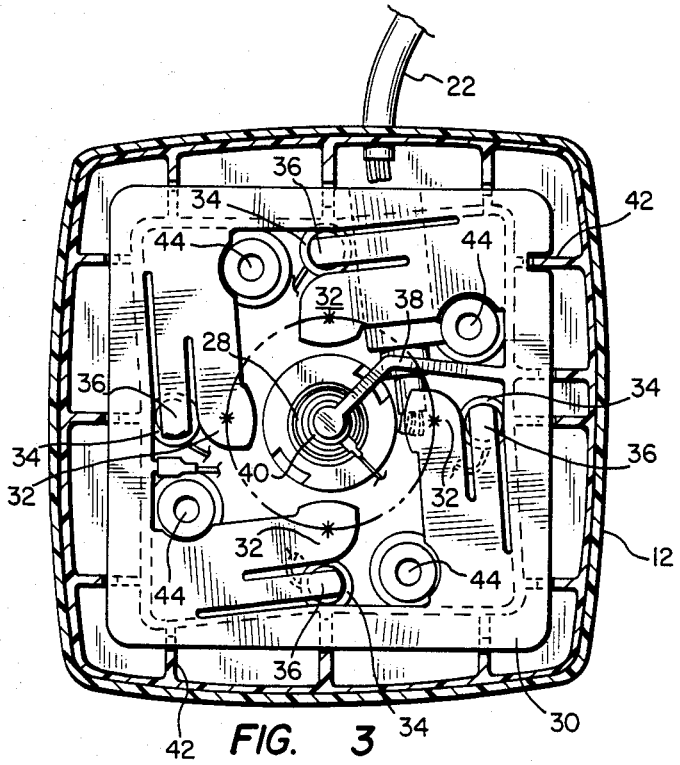
FIG. 3 is a sectional view of the novel digital joystick controller of the present invention taken along line 3—3 of FIG. 2.
Figure 4:
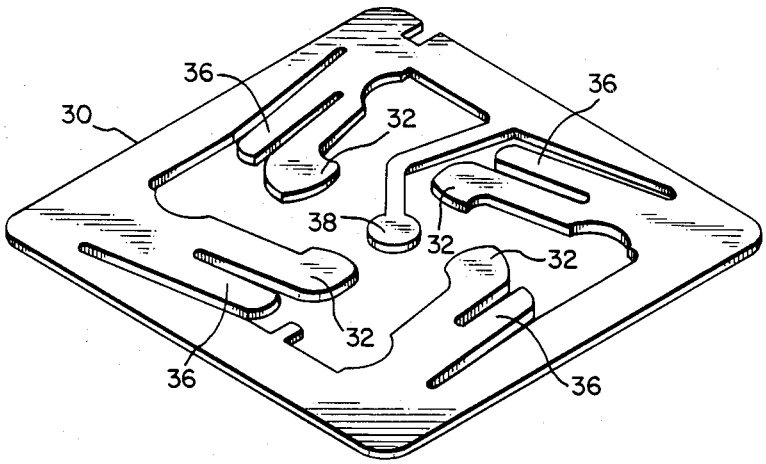
FIG. 4 is a perspective view of the novel spring/contactor of the digital joystick controller of the present invention.

Referring now to FIGS. 2, 3 and 4, the operation and assembly techniques utilized with controller 10 may be illustrated. As seen in FIG. 2, joystick 18 includes a plurality of lobes 24, only two of which are illustrated in the figures. In a preferred mode of the present invention, four such lobes are provided and relative movement of joystick 18 in four directions may then be sensed. Further, the lower end of joystick 18 can be seen to include a concave aperture 26 which pivotally rests upon convex protuberance 28. In this manner, the lower end of joystick 18 is mounted upon and can pivot about protuberance 28. Each one of lobes 24 then rests upon an elongated portion of spring/contactor 30 which serves to urge joystick 18 into the erect position depicted.

Spring/contactor 30 is preferably a planar conductive metal stamping which is configured to have a plurality of elongated leaf spring-like portions 32, each of which rests under a corresponding lobe 24. Spring/contactor 30 is then suspended a selected distance above a plurality of electrical contacts 34. A second plurality of elongate portions 36 of spring/contactor 30 is provided and each portion 36 is associated with a single portion 32. Thus, any manual displacement of joystick 18 from the erect position depicted will cause a downward deformation of a selected portion 32 of spring/contactor 30 due to contact with a lobe 24. The downward deformation of a selected portion 32 of spring/contactor 30 will cause its associated portion 36 to contact its associated contact 34. Those skilled in the art will appreciate that the downward deformation of a selected portion 32 will also cause portion 36 to laterally wipe across the upper surface of contact 34, thus ensuring reliable operation over long periods of time.

In operation, a single wire from control cable 22 is electrically coupled to spring/contactor 30 and a separate wire is coupled to each of electrical contacts 34. Thus, any manual displacement of joystick 18 from the erect position will cause a continuous electrical circuit to be completed between spring/contactor 30 and a selected one of electrical contacts 34. In this manner, a ground potential or a logic level potential may be selectively applied to selected wires within control cable 22 for application to the control system (not shown).

The novel design of spring/contactor 30 also permits simplified manufacture and assembly of "fire" switch 20. As can be seen, fire switch 20 is constructed utilizing an elongate plastic member which is disposed within joystick 18 and which is axially movable therein. The lower end of fire switch 20 rests upon elongate portion 38 of spring/contactor 30. In a manner similar to that which is utilized to urge joystick 18 into an erect position, the natural resilience of the planar metallic material utilized to construct spring/contactor 30 will urge fire switch 20 into the upward position depicted. A manual depression of switch 20 will then deform elongate portion 38 downward into contact with electrical contact 40. Those ordinarily skilled in this art will, of course, recognize that it is also possible to position switch 20 at some location on the upper surface of base portion 14, or, by utilizing simple mechanical linkages, switch 20 may be positioned on the side of joystick 18 in the so-called "trigger" position. Further, it is possible in this last described alternate embodiment to mold joystick 18 into a hand grip or pistol grip shape to facilitate the utilization of a "trigger" switch fire button.

The assembly of controller 10 can now be seen to be greatly simplified. A molded plastic bottom portion 16 of base portion 12 is provided and selected wires from control cable 22 are electrically coupled to contacts 34 and 40 as those contacts are inserted into the base. Spring/contactor 30 is then stamped from a sheet of metallic conductive material and suspended above contacts 34 and 40 by resting upon plastic ribs 42 provided within base portion 16. A selected wire from control cable 22 is then attached to spring/contactor 30 and the upper portion 14 of base portion 12 is attached to lower portion 16 with joystick 18 and fire switch 20 in place. In a preferred mode of the present invention, four screws 44 are utilized to couple upper portion 14 to lower portion 16; however, those skilled in the art will appreciate that other suitable methods such as glue or snap fit connections may be utilized.

Upon reference to the foregoing specification, those ordinarily skilled in the art will appreciate that by utilizing this invention a single planar member may be utilized to perform two major functions within controller 10. The novel design of spring/contactor 30 permits it to serve both as selective electrical contact with the various contacts disposed within base portion 16 and as the spring biasing means for urging joystick 18 into an erect position and for urging fire switch 20 into the upper position. This important feature permits controller 10 to be simply assembled and inexpensively manufactured.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An electronic joystick controller comprising:

a hollow base portion having an upper and lower surface and encompassing a plurality of fixed electrical contact points;

a first elongate member pivotally mounted at a first end thereof through said upper surface of said hollow base portion; and a planar conductive member disposed within said hollow base portion and suspended a selected distance above said plurality of fixed electrical contact points, said planar conductive member having a plurality of coplanar elongate contact portions for urging said first elongate member into an erect position and for contacting selected ones of said plurality of fixed electrical contact points in response to deflection of said coplanar elongate contact portions induced by manual displacement of said first elongate member from said erect position.

2. The electronic joystick controller according to claim 1 wherein said base portion is constructed of plastic.

3. The electronic joystick controller according to claim 1 wherein said plurality of fixed electrical contact points comprises at least four electrical contacts.

4. The electronic joystick controller according to claim 1 wherein said planar conductive member comprises a stamped metal planar member.

5. The electronic joystick controller according to claim 1 further including a plurality of elongate conductive members each of which is electrically coupled to a selected one of said plurality of fixed electrical contact points.

6. The electronic joystick controller according to claim 1 further including a switch movable between a first position and a second position.

7. The electronic joystick controller according to claim 6 wherein said planar conductive member includes an elongate portion thereof for urging said switch into said first position and for electrically contacting a selected one of said plurality of fixed electrical contact points in response to manual urging of said switch into said second position.

8. An electronic joystick controller comprising:

a concave base having a plurality of fixed electrical contact points disposed therein;

a planar conductive member disposed within said concave base and suspended a selected distance above said plurality of fixed electrical contact points, said planar conductive member having a plurality of coplanar elongate contact portions;

a first elongate member pivotally mounted at a first end thereof on said concave base, said first elongate member having a plurality of radial lobes disposed around said first end, each of said radial lobes adapted to mate with a selected one of said coplanar elongate contact portions of said planar conductive member while said first elongate member is in an erect position and wherein manual displacement of said first elongate member from said erect position will result in deflection of at least one of said plurality of coplanar elongate contact portions into electrical contact with at least one of said fixed electrical contact points; and a top portion having an aperture therein for receiving a portion of said first elongate member and having a lower surface adapted to mate with said concave base wherein said planar conductive member is mounted therebetween.

9. The electronic joystick controller according to claim 8 wherein said concave base is constructed of plastic.

10. The electronic joystick controller according to claim 8 wherein said plurality of fixed electrical contact points comprises at least four electrical contacts.

11. The electronic joystick controller according to claim 8 wherein said planar conductive member comprises a stamped metal planar member.

12. The electronic joystick controller according to claim 8 further including a plurality of elongate conductive members each of which is electrically coupled to a selected one of said plurality of fixed electrical contact points.

13. The electronic joystick controller according to claim 8 further including a switch movable between a first position and a second position.

14. The electronic joystick controller according to claim 13 wherein said planar conductive member includes an elongate contact portion thereof for urging said switch into said first position and for electrically contacting a selected one of said plurality of fixed electrical contact points in response to manual urging of said switch into said second position.

15. The electronic joystick controller according to claim 8 wherein said concave base includes a convex protuberance disposed centrally therein and wherein said first end of said first elongate member includes a concave surface adapted to mate with said convex protuberance.

* * * * *